United States Patent [19]

Hanson

[11] 4,346,630

[45] Aug. 31, 1982

[54] RATCHET WRENCH

[75] Inventor: Anthony Hanson, Huntington Beach, Calif.

[73] Assignee: Rodac Pneumatic Tools, Carson, Calif.

[21] Appl. No.: 104,538

[22] Filed: Dec. 17, 1979

[51] Int. Cl.[3] ..... B25B 17/00

[52] U.S. Cl. ..... 81/57.13; 81/57.29; 81/57.39

[58] Field of Search ..... 81/57.39, 57.13, 62, 81/63; 411/160–161, 162, 544, 545

[56] References Cited

U.S. PATENT DOCUMENTS

| | | | |
|---|---|---|---|
| 249,151 | 11/1881 | Allen | 411/545 |
| 2,706,424 | 4/1955 | Johnson | 81/63 |
| 2,711,111 | 6/1955 | Brame | 81/63 |
| 3,529,498 | 9/1970 | Northcutt | 81/57.13 |

*Primary Examiner*—James L. Jones, Jr.
*Attorney, Agent, or Firm*—Herzig & Walsh, Inc.

[57] ABSTRACT

Ratchet wrench, having a motor drive and having a member which oscillates angularly, cooperating with a rotor, which intermittently drives a shaft angularly through a pre-determined number of degrees, the shaft being configurated to carry a socket to fit a nut to be turned. The wrench has a head which carries the oscillating member and a ratchet pawl. A manual adjustment is provided to adjust the pawl for driving the shaft in either direction as desired. The ratchet pawl is carried in the rotor member which is mounted in the head and which carries the shaft on which is mounted the socket for fitting on the nut to be turned. All of the parts are held within the head with appropriate friction being applied to the rotor by use of a wave washer.

2 Claims, 5 Drawing Figures

RATCHET WRENCH

BACKGROUND OF THE INVENTION

1. Field of the Invention

The field of the invention is that of ratchet wrenches.

2. Description of the Prior Art

Ratchet wrenches which are held in the hand and are driven by a motor are commercially known in the art. Such wrenches typically embody a handle part and a head with an extending shaft adapted to have mounted on it a socket which can engage a nut for turning it. Drive means are provided whereby the ratchet wrench will cause the drive shaft to move angularly in steps of predetermined amount.

Typically, there is a member which is mounted to be oscillated by the drive motor and a ratchet pawl is positioned to cooperate with the oscillating member, the ratchet member causing the angular step movement to be transmitted to the shaft.

The head of the wrench typically, is relatively small and the above-described parts are incorporated in the head. Ordinarily, a cylindrical member or rotor is provided which carries the shaft which is moved angularly. For proper operation, means are provided to apply friction to the circular member or rotor. Known commercial devices as described have been subject to certain deficiencies. Among these were that the parts as described within the head were put together with members requiring particularly that the circular member or rotor have a number of holes in it which cause it to be weakened with the result that it would frequently break under the stress of operation. Also, the means provided for applying friction to this member were relatively complicated and required providing the rotor with holes which weakened it.

SUMMARY OF THE INVENTION

In the preferred exemplary form of the invention as described in detail herein, it embodies a ratchet wrench having a handle part in which is embodied a drive motor which is preferably an air motor.

The wrench has a head which is bifurcated to form a yoke, in which is received a member that is oscillated angularly by way of a drive shaft and crank pin driven by the motor.

Inside of the head is provided a circular member or rotor which carries the shaft which is configurated to receive a socket which can fit on a nut to be turned.

The circular member or rotor carries a double acting drive pawl mounted on a pin which is positioned to engage with teeth formed in a bore in the aforesaid oscillating member.

The sides of the bifurcated head or yoke have bores to receive the parts as described. A wave washer is used against one side of the rotor to apply friction without the need of making holes in the rotor. All parts are held in assembled relationship within the head by way of a snap ring received in the bore on one side of the head.

In the light of the foregoing, the primary object is to realize a ratchet wrench of the type described having a head within which is a rotor carrying a ratchet pawl and carrying a drive shaft, the rotor being frictionally restrained by way of a wave washer acting on a side of the rotor.

Another object is to realize a ratchet wrench assembly as in the foregoing wherein all parts are held in an assembled relationship within the head by way of disc members and a snap ring without other fasteners.

Further objects and additional advantages of the invention will become apparent from the following detailed description and annexed drawings.

DESCRIPTION OF THE PREFERRED EMBODIMENT AND BEST MODE OF PRACTICE OF THE INVENTION

Figures 1, 2:
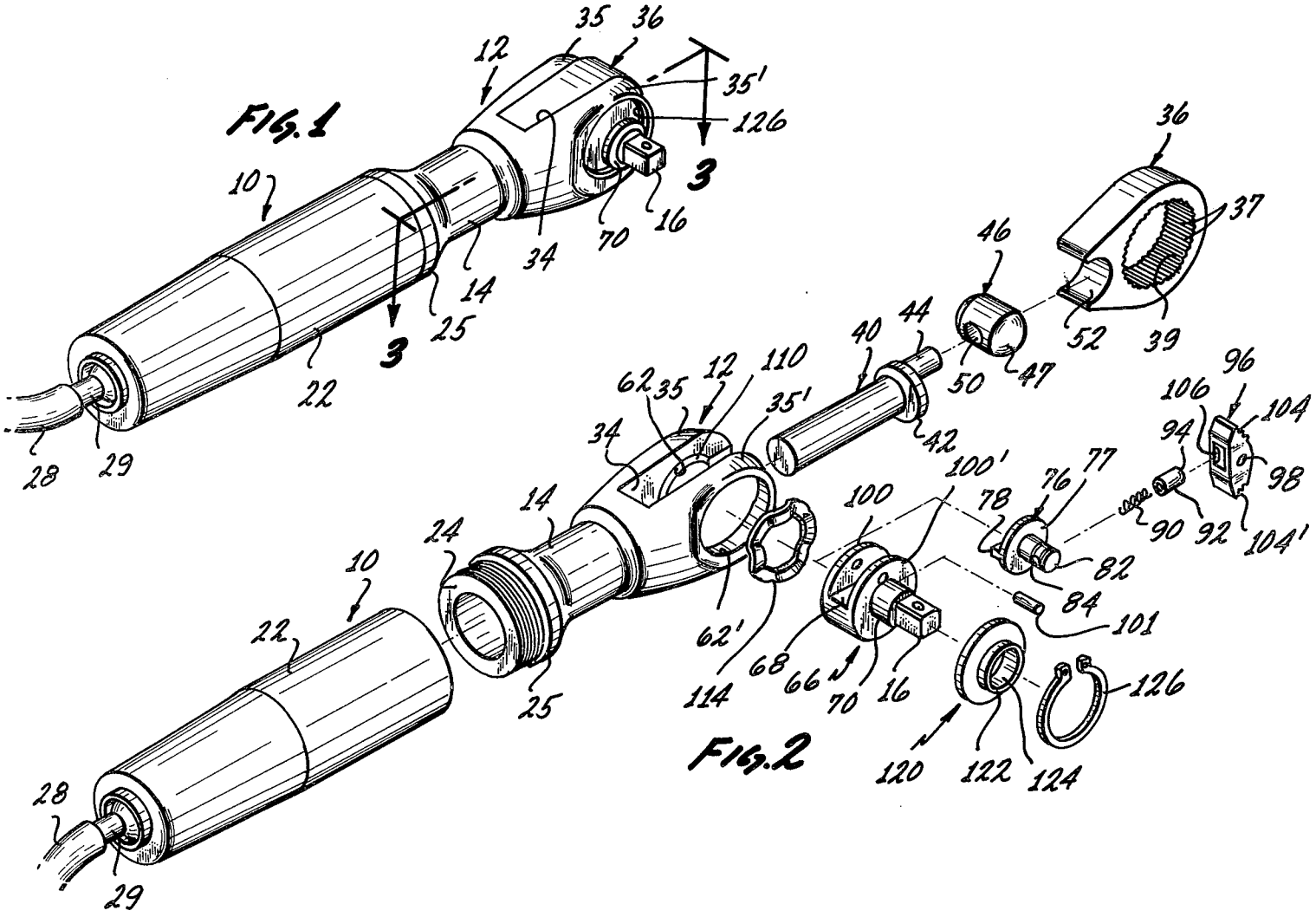
FIG. 1 is a pictorial, isometric view of a wrench embodying the invention.
FIG. 2 is an exploded isometric view showing the parts of the wrench of FIG. 1.

Referring to the drawings, FIG. 1 is an external view of a preferred form of the invention. As shown, there is a handle part 10 and a head 12 with a narrowed neck, part 14, in between the handle and the head part. Within the head part 12 is a mechanism as will be described, which can rotate a shaft through an angle of a pre-determined amount or extent in either direction. On the shaft, is an extending square item 16, adapted to have a socket fitted onto it for engaging a nut to be turned.

The handle part 10 includes a section or part 22 which can be threaded onto a threaded boss 24 adjacent to a collar 25, which is part of the neck section 14. Within the handle part 1, there is provided a driving motor which may be of any type such as, for example, an electric motor or an air-driven motor. In the form of the invention shown, the wrench is driven by an air motor supplied with air through an air line as designated at 28, which is coupled to fitting 29 at the end of the part 10 of the wrench.

The improvements of the invention reside primarily in the parts or mechanism whereby rotation of the shaft of the driving motor is caused to impart the angular movement in either direction to the stem 16.

Figure 3:
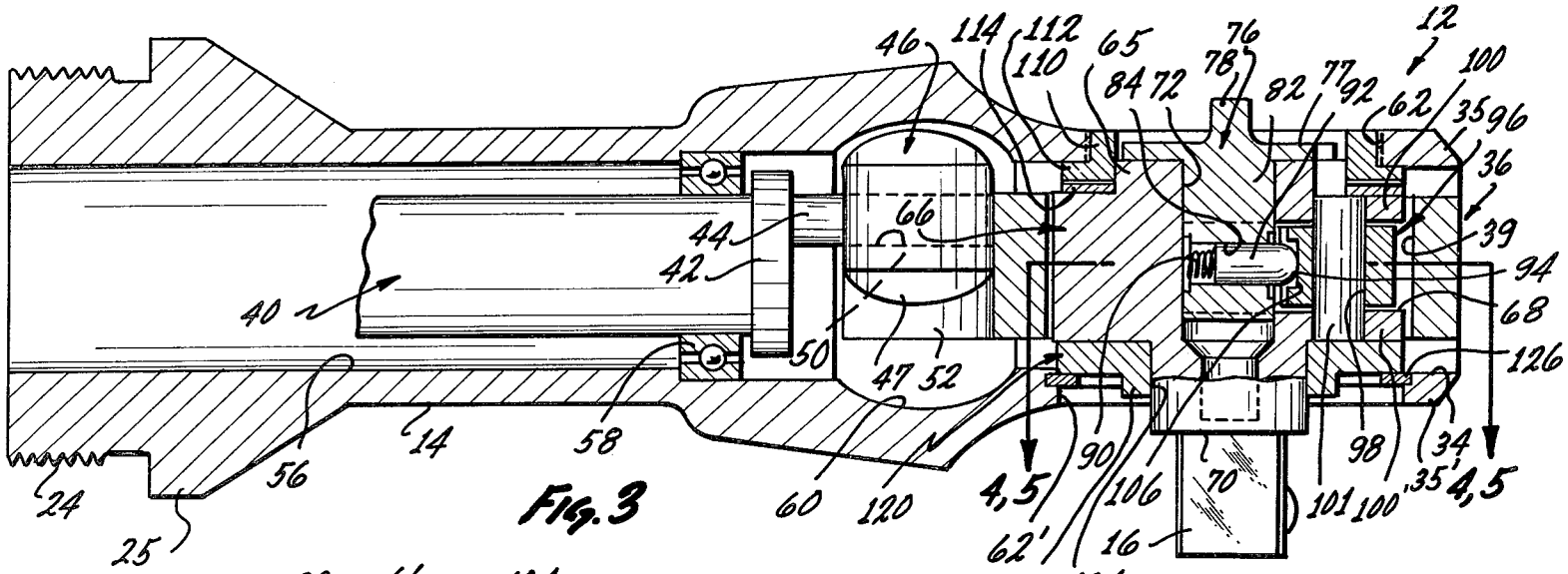
FIG. 3 is a sectional view taken along the line 3—3 of FIG. 1.
Figure 5:
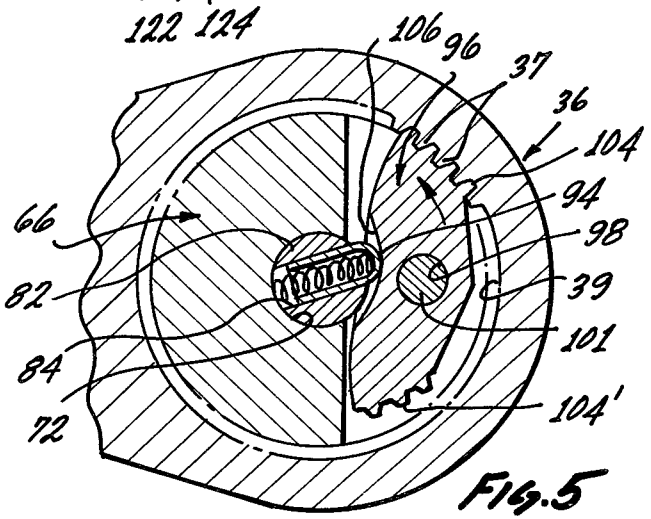
FIG. 5 is a sectional view taken along the line 5—5 of FIG. 3, with the parts in a different position.
Figure 4:
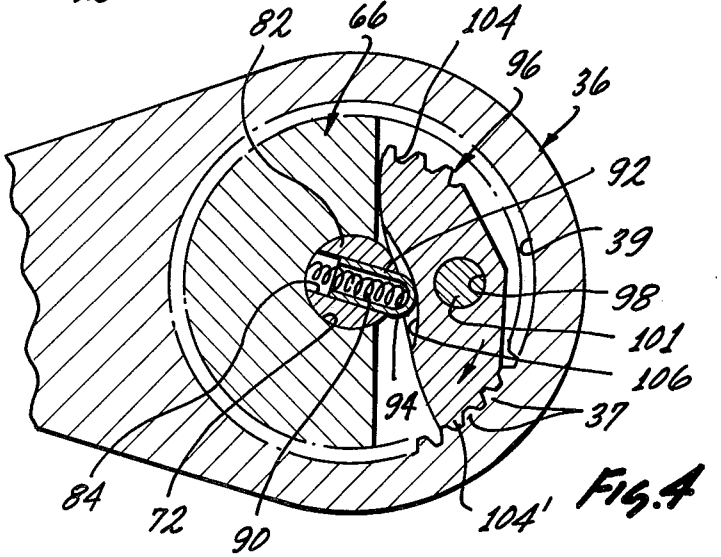
FIG. 4 is a sectional view taken along the line 4—4 of FIG. 3.

The parts of the mechanism are shown in the exploded view FIG. 2 and the parts are shown in an assembled relationship in the cross-sectional view of FIG. 3 and in FIGS. 4 and 5.

The head 12 has a longitudinal slot in it as designated at 34, so that it forms a yoke having sides 35 and 35'. Numeral 36 designates an oscillatory member that oscillates angularly about the axis of the square end fitting 16 as will be described. The oscillating part or member 36 fits into the yoke in head 12, that is it fits into the slot 34 as may be seen in FIG. 3.

Numeral 40 designates a crank shaft having on it a flange 42 from which extends a crank No. 44, which is off center from the center of the shaft as shown. Numeral 46 designates a drive bushing which is generally cylindrical, having spherical shaped ends, one of which is shown on 47. The drive bushing 46 has a transverse hole or aperture 50 in it, which receives the crankshaft stem 44. As may be seen, the end of the oscillatory member 36 has a semi-circular opening in it as shown at 52 of a size to receive the drive bushing 46 in it, with a sliding fit. As may be seen, as the stem 44 rotates, while fitting in the hole 50, the drive bushing 46 is caused to move up and down along with some axial movement and since it is positioned within the semicircular opening 52 in the member 36, that member is caused to oscillate about the axis of the square shaft 16. The member 36 has a circular opening 39 in it and on the inside surface of the opening are teeth 37 which will be referred to again presently.

The neck part 14 as shown in FIG. 3 has a bore 56. The crankshaft 40 is positioned in this bore being journalled in a bearing as designated at 58, the crankshaft 40, of course, being driven by the motor that is in the handle part 10. The head 12 has an interior opening as designated at 60 which receives the end part of the oscillating member 36 and the driving bushing 46 which rotates in the opening 52.

The sides or legs of the yoke formed by the head 12 are designated by the numerals 35 and 35' and each one of these legs has in it a circular hole or bore as designated at 62 and 62'.

The head 12 in addition to receiving the oscillating member 36 receives a group of parts which fit into the bore 39 in the oscillatory member 36, these parts being individually illustrated in FIG. 2 and in assembled relationship in FIG. 3.

Numeral 66 designates a rotor or rotary member, having a size to fit into the bore 62' in the head 12 and to be received in the bore in the oscillatory member 36. See FIGS. 3, 4 and 5. The rotor member 66 has a generally circumferential slot in it as designated at 68, that extends through ½ of the circumference, that is, approximately 180°. In FIG. 2, the part 66 is shown in a position turned 90° counterclockwise from the position it actually occupies within the head 12 in the bore 39 of part 36. It has an extending shaft 70 on the end of which is the square shaft 16 previously referred to in connection with FIG. 1.

The part 66 has an axial bore in it as designated at 72 as may be seen in FIG. 3. This bore intersects the bottom of the circumferential slot 68 as may be seen in FIGS. 4 and 5.

Numeral 76 designates a setting member by means of which the direction can be set, whether clockwise or counterclockwise that the square stem 16 is to be angularly moved by the wrench. The member 76 includes a disc 77 having a fingerpiece 78 extending from one side as may be seen in FIG. 3, to allow it to be manually rotated as will be further described presently. The setting number 76 has an extending shaft 82, which has a transverse bore in it, as designated at 84. See FIGS. 4 and 5. The setting piece 76 is constructed to have its shaft 84 inserted into the bore 72 in the rotor part 66 as may be seen in FIGS. 4 and 5.

Received in bore 84 is a coil spring 90 which fits into a bore in a plunger 92, having a round nose or end 94. Numeral 96 designates a ratchet pawl having a shape as may be best seen in FIGS. 4 and 5. It has a transverse bore 98 through it so that it can be mounted in the circumferential slot 68 in the rotor member 66 by way of inserting a pin through the sides 100 and 100' of the sides of the member 66 and through the bore 98 of ratchet pawl 96. Such a pin is shown at 101 in FIGS. 4 and 5. The ratchet pawl 96 has slanted or generally acruate end parts as designated at 104 and 104'. These portions have teeth that are configurated to engage with the teeth 36 on the inside of the bore 39 of part 36 as may be seen in FIGS. 4 and 5. The ratchet pawl 96 has a groove or channel formed in its left side as designated at 106 in FIGS. 4 and 5 and FIG. 3 and blunt nose 94 of the plunger 92 seats in this groove or channel by being urged thereinto by the spring 90. Thus, it may be seen that by manually rotating the setting number 76 by a means of the part or handle of 78, the shaft 82 can be rotated angularly, which rotates the plunger member 92 so that its nose can be moved between the two positions as shown in FIGS. 4 and 5. In one of these positions, the ratchet pawl 96 is positioned to be oscillated by the member 36 angularly in one direction and when the ratchet pawl is in its other position as shown in FIG. 5, it is positioned to be rotated by the oscillatory member 36 angularly in the opposite direction. Each end of the ratchet pawl operates only in one direction, and is free to move in a direction opposite to that direction.

Referring to FIG. 3, on the top side of the rotor member 66, which is the left side in FIG. 2, it has an extending boss 65. Numeral 110 in FIG. 3 designates a ring member of a size to fit into the bore 62 and having an extending flange 112 of larger diameter. Between the flange 112 and the flat surface of part 66, adjacent to the boss 65, is a thrust washer 114. This is a known type of member made of a material which has resilliency, such as spring steel, having waves in it or bends in a circumferential direction so that it can be pressed between the members on opposite sides of it, exerting force against them.

FIG. 3 shows the individual parts that are illustrated in FIG. 2 assembled in the bores 62 and 62' in the legs 35 and 35' of the yoke formed by the head 12. Numeral 120 designates a plate having an extending circular boss 122 and having a bore 124 of a size to fit on the shaft 70. The plate 120 fits into the bore 62' and it is held by a snap ring 126 that fits into an undercut in the bore 62'.

From the foregoing, those skilled in the art will readily understand the operation of the wrench. The driving motor rotates the crankshaft 40 which in turn oscillates the bushing member 46 which oscillates the member 36 around the axis of the shaft 82 and the square end 16.

The ratchet pawl 96 may be either in the position of FIG. 4 or FIG. 5 depending on the adjustment of the adjustment member 76–78. As the member 36 oscillates about its axis, it will move the ratchet pawl 96 a similar number of degrees in the same direction and this correspondingly rotating the rotor 66 and the shaft 70 and the square end 16 the same number of degrees in the same direction. This number of degrees of movement will occur upon each oscillation of the member 36 and the rotative effect will be applied to the socket on the square end 16 and, accordingly, to a nut to be tightened.

The plunger 92, of course, applies appropriate pressure to the ratchet pawl 96 which is able to rotate on its pivot 101 as may be seen in FIGS. 4 and 5. The plunger 92 as described fits into the bore 84 in the shaft 82.

The rotor 66 is held in position with the head 12 by the end plates 110 and 120, the plate 120 being held by the snap ring 126 as described. The spring steel thrust washer 114 is in between the plate 110 and an end surface of the rotor 66 to apply the appropriate amount of tension and friction to the rotor 66. Additional holes other than those described are not required in any of the parts which would tend to weaken them.

From the foregoing, those skilled in the art will readily recognize and understand the manner in which the objects as set forth in the foregoing are realized and the manner in which the improvements of the invention are achieved.

The foregoing disclosure is representative of a preferred form of the invention and is to be interpreted in an illustrative rather than a limiting sense, the invention to be accorded the full scope of the claims appended hereto.

I claim:

1. In a ratchet wrench assembly having a head and a handle part and motor drive means, the head being bifurcated forming a yoke, having legs, the side parts of the head each having a circular bore therein, an angularly oscillating member positioned between the legs of the yoke the oscillatable member having a toothed bore, and means for oscillating the said member, the improvements comprising a rotor member mentioned within the head, the rotor member carrying a ratchet pawl positioned to be engagable with the teeth in the bore of the oscillating member, shaft means driven by the rotor member, means for holding the rotor member in position in the head, and a friction member mounted between a part of the said rotor and the holding means, the holding means including at least one bushing having a part fitting in one of said bores, the bushing having a radial flange part, the said rotor part having a portion of larger diameter and a portion of smaller diameter with an annular shoulder between said portions, the friction member being a flat wave washer lying between said flange and a radial surface of the rotor member formed by said portion of smaller diameter, adjacent to said annular shoulder.

2. A ratchet wrench as in claim 1 including a second bushing member, which is positioned in the other of the circular bores in the side part of the head and means including a snap ring positioned in an undercut groove in the said other bore holding the said second bushing member in position, the second bushing member having a bore in which is received a part of the rotor member.

* * * * *